US007461698B2

(12) United States Patent
Klipstein

(10) Patent No.: US 7,461,698 B2
(45) Date of Patent: Dec. 9, 2008

(54) REMOTELY OPERABLE TOP DRIVE SYSTEM SAFETY VALVE HAVING DUAL VALVE ELEMENTS

(76) Inventor: Michael R. Klipstein, 4018 W. Old Spanish Trail, New Iberia, LA (US) 70560

( * ) Notice: Subject to any disclaimer, the term of this patent is extended or adjusted under 35 U.S.C. 154(b) by 168 days.

(21) Appl. No.: 11/186,484

(22) Filed: Aug. 22, 2005

(65) Prior Publication Data

US 2007/0039758 A1 Feb. 22, 2007

(51) Int. Cl.
*E21B 34/00* (2006.01)
*E21B 33/06* (2006.01)

(52) U.S. Cl. ..... 166/332.4; 175/218; 251/340; 251/231; 251/279

(58) Field of Classification Search ..... 175/113, 175/218; 166/332.3, 330, 85.4; 251/58, 251/231, 249, 279, 340
See application file for complete search history.

(56) References Cited

U.S. PATENT DOCUMENTS 3,887,161 A * 6/1975 Kubelka, Jr. ..... 251/58
3,941,348 A * 3/1976 Mott ..... 251/58
4,519,576 A * 5/1985 Winegeart ..... 251/62
4,535,852 A * 8/1985 Boyadjieff et al. ..... 175/170
6,662,886 B2 * 12/2003 Russell ..... 175/218
6,840,493 B2 * 1/2005 York et al. ..... 251/58
2004/0000405 A1 * 1/2004 Fournier et al. ..... 166/373
2005/0081918 A1 * 4/2005 Seneviratne et al. ..... 137/375

* cited by examiner

*Primary Examiner*—Jennifer H Gay
*Assistant Examiner*—Daniel P Stephenson
(74) *Attorney, Agent, or Firm*—Law Office of Jesse D. Lambert, LLC

(57) ABSTRACT

Disclosed is a remotely operable top drive safety valve assembly having first and second valve elements. An actuator sleeve moves longitudinally on the main body of the top drive safety valve assembly under the influence of an operating arm. When operating the first valve element, a lock plate is preferably installed over the second valve element stem, and an arm is externally fixed to the stem of the first valve element and is disposed in a cutout in the wall of the actuator sleeve. Movement of the actuator sleeve up and down moves the arm, and thereby moves the first valve element between open and closed positions. When operating the second valve element, the arm on the upper valve element stem is removed, a lock plate is preferably installed over the first valve element stem, an arm is installed on the second valve element stem, and a linkage assembly is installed which operationally engages the second valve element stem arm with the actuator sleeve. Longitudinal movement of the actuator sleeve moves the second valve element between open and closed positions via the linkage assembly.

3 Claims, 7 Drawing Sheets

TOP DRIVE SYSTEM (GENERAL LAYOUT)

TOP DRIVE SYSTEM (VALVE LOCATIONS)

REMOTELY OPERABLE TOP DRIVE SYSTEM SAFETY VALVE HAVING DUAL VALVE ELEMENTS

CROSS REFERENCE TO RELATED APPLICATIONS

None.

BACKGROUND

1. Field of Art

This invention relates to apparatus used in connection with the drilling of subterranean boreholes, which in the oil and gas industry are commonly called "wells." With further specificity, this invention relates to a type of remotely operable safety valve disposed in the drill string below a top drive unit, the valve having more than one valve element therein.

2. Description of the Related Art

The use of so-called "top drive units" on rotary drilling rigs, in the drilling of oil and gas wells, has become quite common. Rather than utilizing the rig's rotary along with a kelly bushing and kelly to rotate the drill string, the top drive rotates the drill string by a large electric motor mounted in an assembly which is raised and lowered by the rig's traveling block. FIGS. 1 and 2 show the general layout. Typically, the traveling block runs on a pair of guide rails to hold it oriented over the borehole. Drilling fluid is pumped down through the main shaft of the top drive.

The typical sequence of equipment from the bottom of the main shaft of the top drive to the top of the drill string includes (in descending order): the threaded end of the main shaft; the remotely operable top drive safety valve; the manually operable top drive safety valve; a saver sub; and the uppermost "box" connection of the drill string. FIG. 3 shows this sequence of equipment. In the normal course of drilling, both the remotely operable and manually operable top drive safety valves must be open to permit drilling fluid to be pumped down the drill string. Both top drive safety valves have valve elements therein to control fluid flow, which are typically (but not necessarily) "ball valves," which, as is well known in the art, employ a generally spherical "ball" having a bore through it and attached to a valve stem. Rotating the stem (usually by means of an external arm connected thereto), and consequently the ball, so that the bore of the ball is aligned with the bore of the valve body opens the valve element and permits fluid flow therethrough. Rotating the ball typically ¼ rotation from the open position presents a solid surface of the ball to the valve bore, thereby shutting off fluid flow through the valve. Other types of valve elements may be used (butterfly, gate, etc.)

The top drive safety valves are very important devices to control fluid flow and pressure. Regulations require that at least one of the top drive safety valves be remotely operable, by some powered means. In this description, by way of example, the uppermost top drive safety valve is shown as the remotely operable top drive safety valve (however, it is understood that the remotely operable top drive safety valve could be positioned above or below the manually operated safety valve). Remotely operable top drive safety valves usually employ a longitudinally slidable actuator sleeve which operatively engages the external arm attached to the stem of the valve element, to open and close it. The actuator sleeve is moved up or down by a powered (typically pneumatic or hydraulic) operating arm. Known prior art remotely operable top drive safety valves comprise only a single valve element therein.

Regulations further require that the top drive safety valves be periodically function and pressure tested. Should the remotely operable top drive safety valve fail the pressure test (that is, even when the valve element is closed, it is not pressure and flow tight), the valve must be repaired, usually done by removing the valve from the top drive assembly and replacing it with a standby valve, while the malfunctioning safety valve is sent to a repair facility. Significant time is needed to remove the top drive safety valve from the drill string. While the top drive safety valve is being removed, and another one installed, drilling operations are at a standstill. With many offshore drilling operations having overall daily costs of $100,000 or more, it is readily appreciated that downtime associated with replacement of top drive safety valves is very costly.

Therefore, a need exists for a remotely operable top drive safety valve, especially for use in conjunction with top drive drilling units, comprising multiple valve elements, so that when one valve element fails to pressure test, the second (or third, etc.) valve element can be put into service without removing the top drive safety valve from the drilling assembly. The dual valve elements will permit at least twice the service time as with a top drive safety valve comprising only a single valve element.

DETAILED DESCRIPTION OF THE PREFERRED EMBODIMENT

Figure 1:
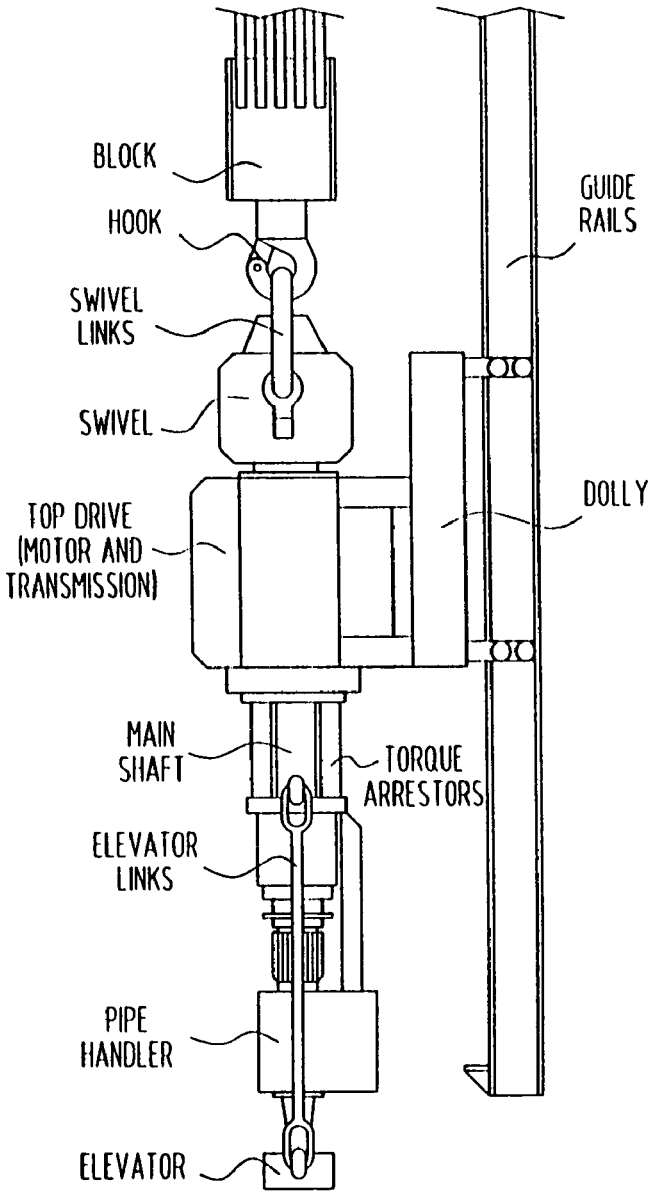
FIG. 1 (PRIOR ART)
FIG. 1 is a drawing of the general layout of a top drive unit.

The present invention is a remotely operable top drive safety valve, having first and second valve elements, particularly suitable for placement in a drillstring below a top drive drilling system (commonly called a "top drive unit") on a drilling rig. FIG. 1 shows a conventional top drive system, with its main elements labeled.

Figure 2:
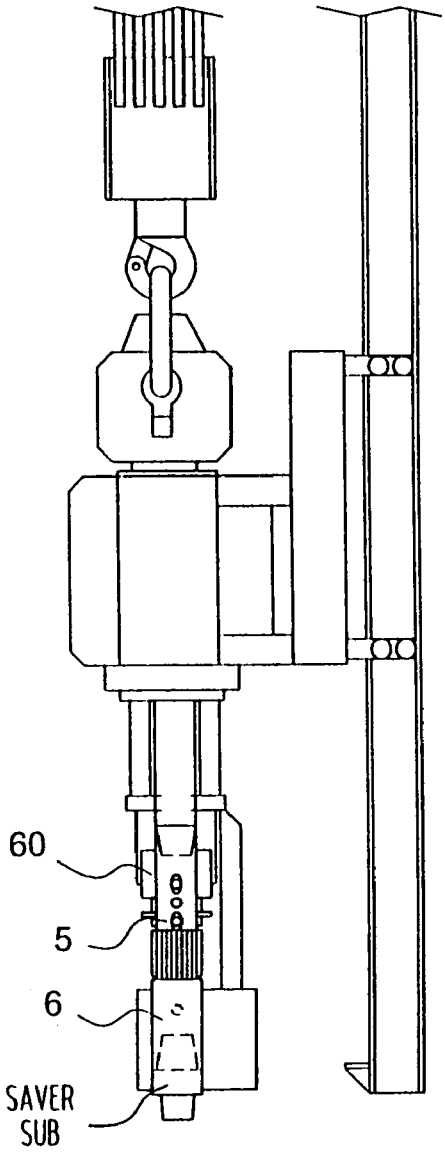
FIG. 2 (PRIOR ART)
FIG. 2 is a drawing showing placement of the remotely operable and manually operable top drive safety valves, in place on a top drive unit.
Figure 3:
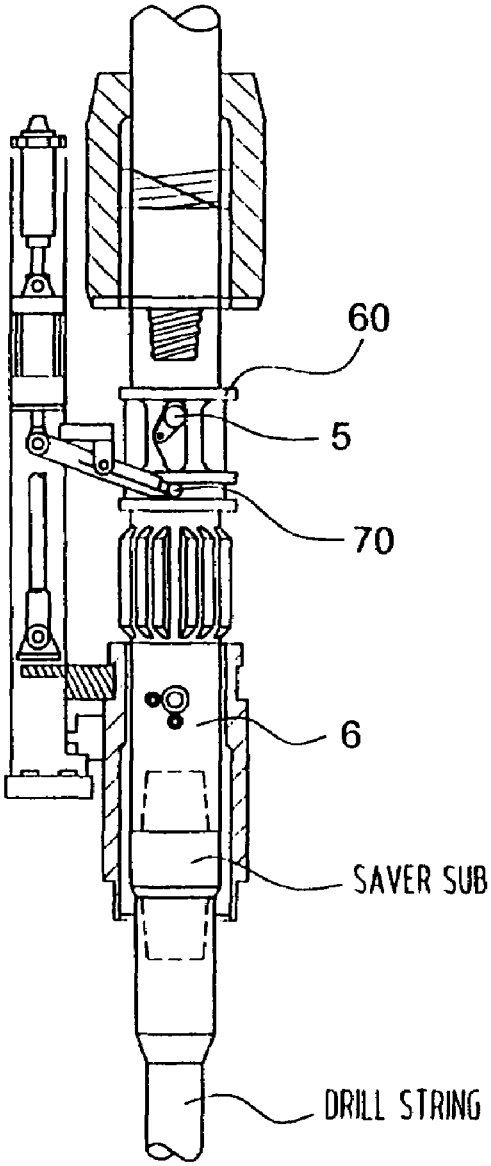
FIG. 3 (PRIOR ART)
FIG. 3 shows more detail on the top drive safety valve positions.
Figure 3A:
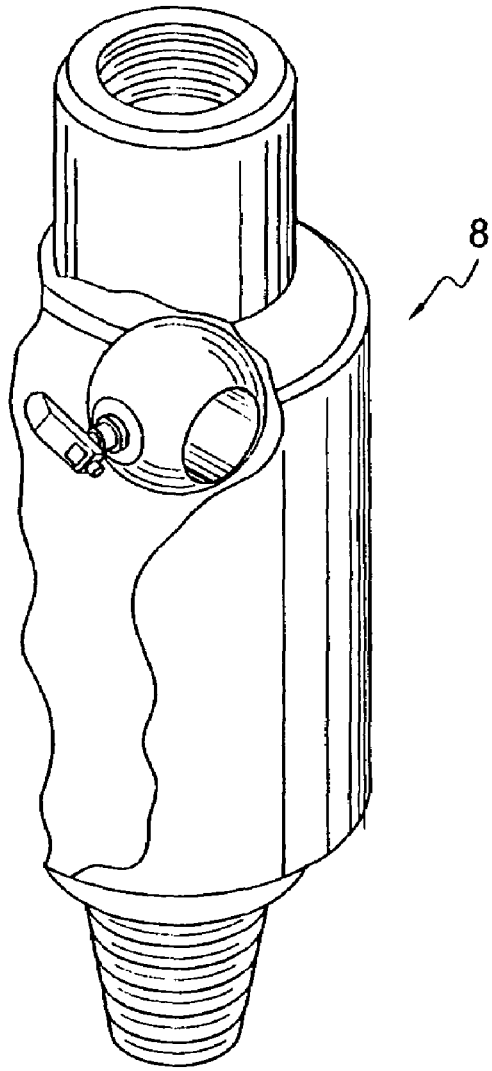
FIG. 3A (PRIOR ART)
FIG. 3A shows the general configuration of a prior art valve, having a single ball valve element.

FIG. 2 shows a typical top drive system in more detail. Typically, a remotely operable top drive safety valve 5 and a manually operated top drive safety valve 6 are employed (usually, although not necessarily, with the remotely operable valve disposed above the manually operated valve, as shown). As described above, the remote operation is commonly done by means of a longitudinally slidable actuator sleeve 60, as shown in FIG. 2, disposed around the body of the valve, the actuator sleeve moved upwardly or downwardly to interact with the external arm connected to the valve element stem, and rotate the valve element (again, typically a ball valve element) to an open or closed position. A hydraulically powered and remotely controlled arm 70, as can be seen in FIG. 3, engages the actuator sleeve to move it up and down. FIG. 3A simply shows the general structure of a typical prior art valve 8 having a ball valve element therein.

One prior art attempt to remotely operate a drill string safety valve (albeit in conjunction with a conventional drilling kelly, not a top drive system) is disclosed in U.S. Pat. No. 4,519,576 to Winegeart.

The present invention comprises a remotely operable top drive safety valve assembly having two valve elements. Preferably, the two valve elements are of the form commonly known as "ball valves," where a substantially spherical member with a bore through it rotates within the body of the valve. A ball valve is open when the ball is rotated so that the bore in the ball is aligned with the bore in the body of the valve. The valve is closed when the bore in the ball is rotated completely out of communication with the bore in the body of the valve (typically via a 90 degree turn). However, it is understood that any type of valve elements (flapper, butterfly, gate, etc.) are encompassed within the scope of the present invention.

In further detail, referring to the drawings, particularly to FIGS. 4A-8, the present invention comprises a top drive safety valve assembly 10 comprising an elongated, generally circular in cross section main body 20 having a longitudinal bore 30 through it. First and second valve elements are disposed in the main body, referred to herein as first valve element 40 and lower valve element 50. Valve elements 40 and 50 are locationally shown on FIGS. 4A-7B, and are shown in cross section in FIG. 8. For illustrative purposes, the valve elements shown are ball valve elements. Each ball valve element, as described above, has a bore therethrough, and can be rotated between open and closed positions.

Figure 4A:
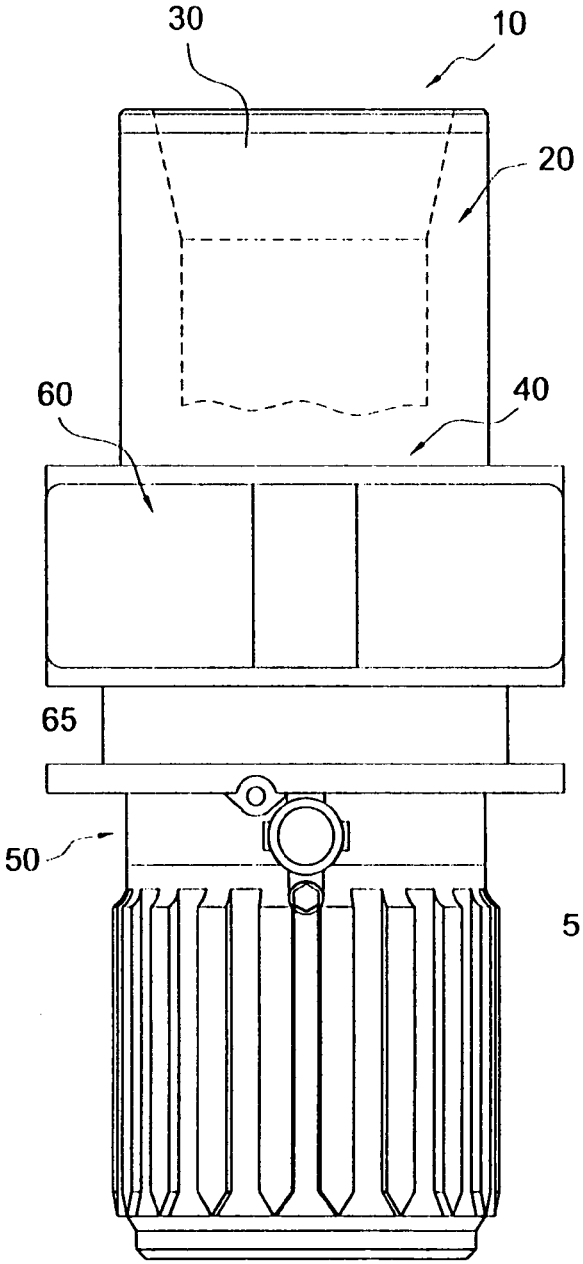
FIGS. 4A and 4B are views of the remotely operable top drive safety valve of the present invention, configured to operate the first valve element thereof.
Figure 4B:
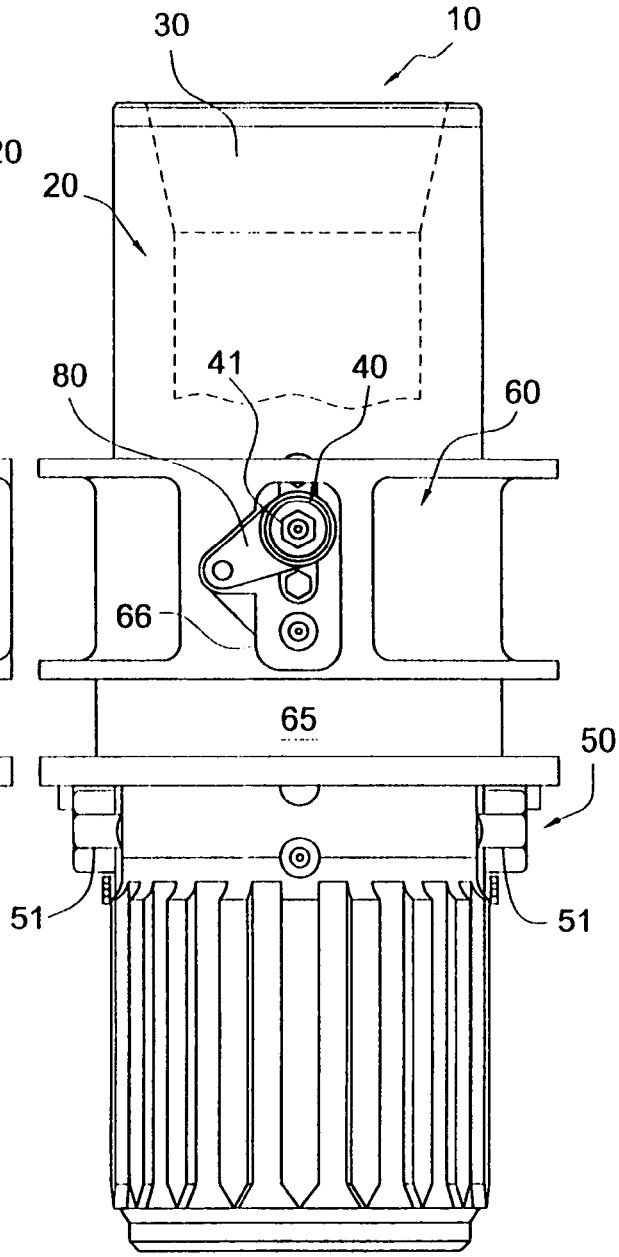

FIGS. 4A, 4B, 5A, and 5B show the present top drive safety valve assembly with the first valve element in service. FIGS. 4A and 4B both show first valve element 40 in an open position; those two figures show the top drive valve assembly when viewed from two different directions 90 degrees apart. With reference to those drawings, an actuator sleeve 60 is disposed around main body 20 and is longitudinally slidable along main body 20. Actuator sleeve 60 typically comprises profiles or grooves 65 to engage an actuating arm 70 (shown in FIG. 2, said actuating arm being remotely operable typically by hydraulic or pneumatic means) which moves the actuator sleeve up and down along the main body. First valve element 40 has a stem 41 which preferably extends through main body 20, emerging on each side of main body 20.

Figure 5A:
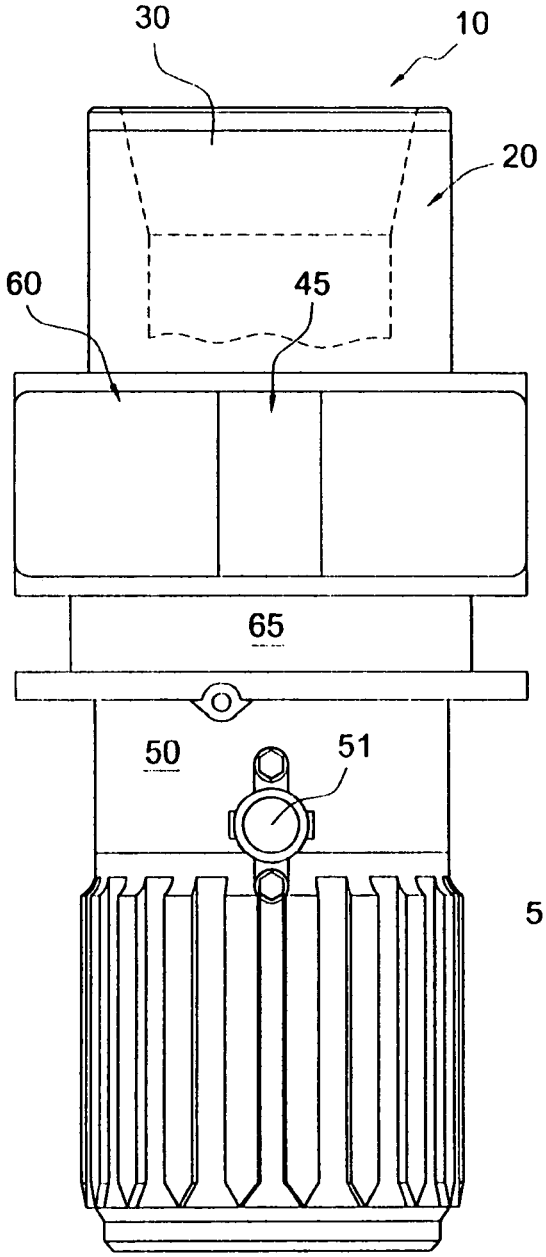
FIGS. 5A and 5B are views of the remotely operable top drive safety valve of the present invention, configured to operate the first valve element thereof, with the actuating sleeve shifted from the position shown in FIGS. 4A and 4B.
Figure 5B:
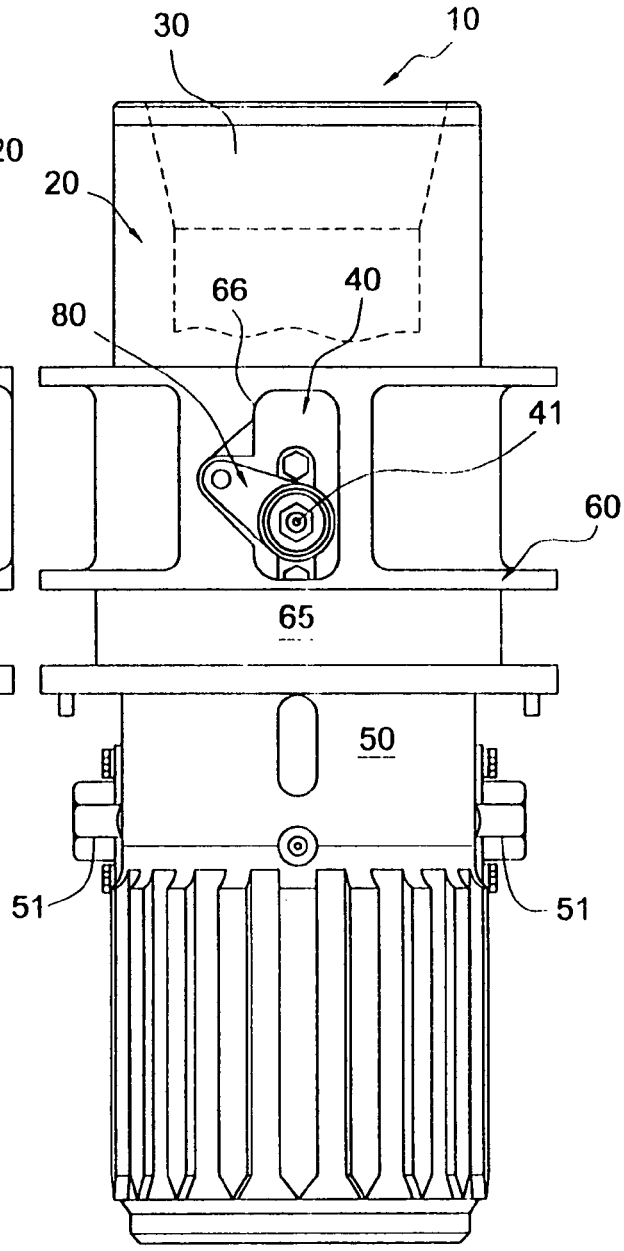

The invention further comprises a means for operationally engaging actuator sleeve 60 with first valve element 40 (or with second valve element 50, as described below). In a presently preferred embodiment, the means for operationally engaging actuator sleeve 60 with first valve element 40 comprises at least one external arm 80, mounted on one or both ends of the valve element stem. It is understood that upper valve, 40 could have only a single stem and crank assembly. The means for operationally engaging actuator sleeve 60 with first valve element 40 further comprises a profile 66 in actuator sleeve 60 (which, as shown, comprises a cutout in the wall of actuator sleeve 60) which operationally engages upper valve via arm 80. Movement of actuator sleeve 60 longitudinally along main body 20 moves the arm 80, and consequently the valve element stem and valve elements (ball elements illustrated) to which they are attached, through a roughly 90 degree rotation. First valve element 40 can therefore be opened or closed as desired by moving actuator sleeve 60 longitudinally along main body 20, which in turn forces the arm 80, stem, and valve element to an open or closed position. FIGS. 5A and 5B show actuator sleeve 60 moved longitudinally upward, moving arm 80 (and consequently stem 41) and placing first valve element 40 in a closed position.

Figure 6A:
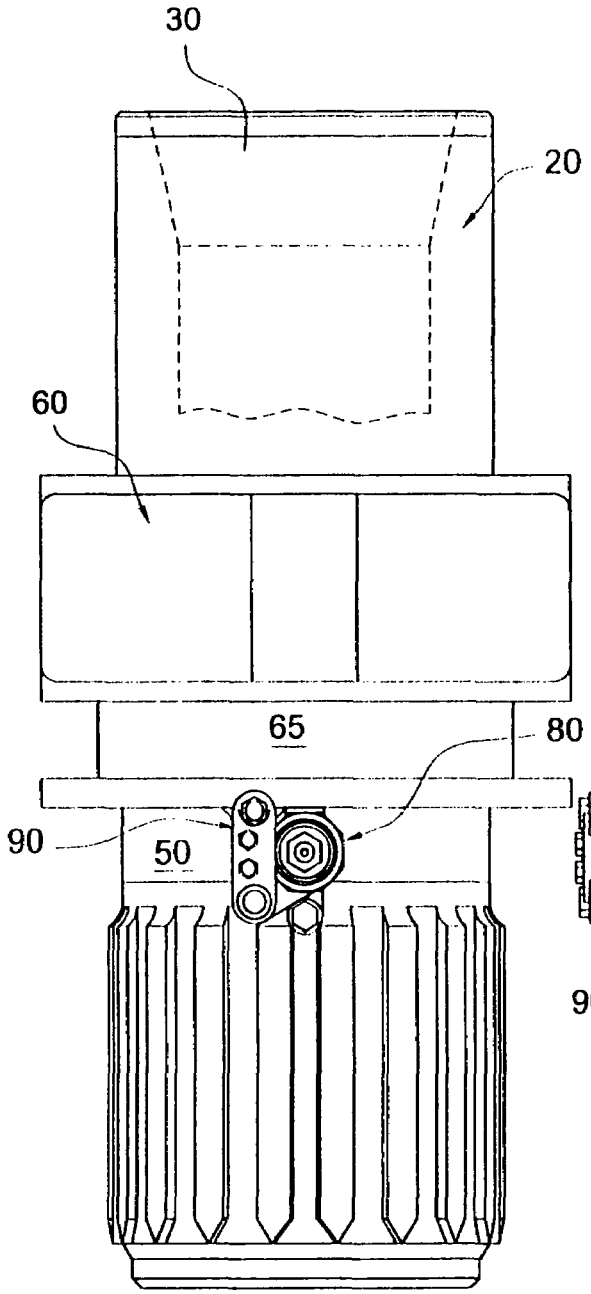
FIGS. 6A and 6*b* show the remotely operable top drive safety valve of the present invention, with the linkage assembly installed to operate the second valve element.
Figure 6B:
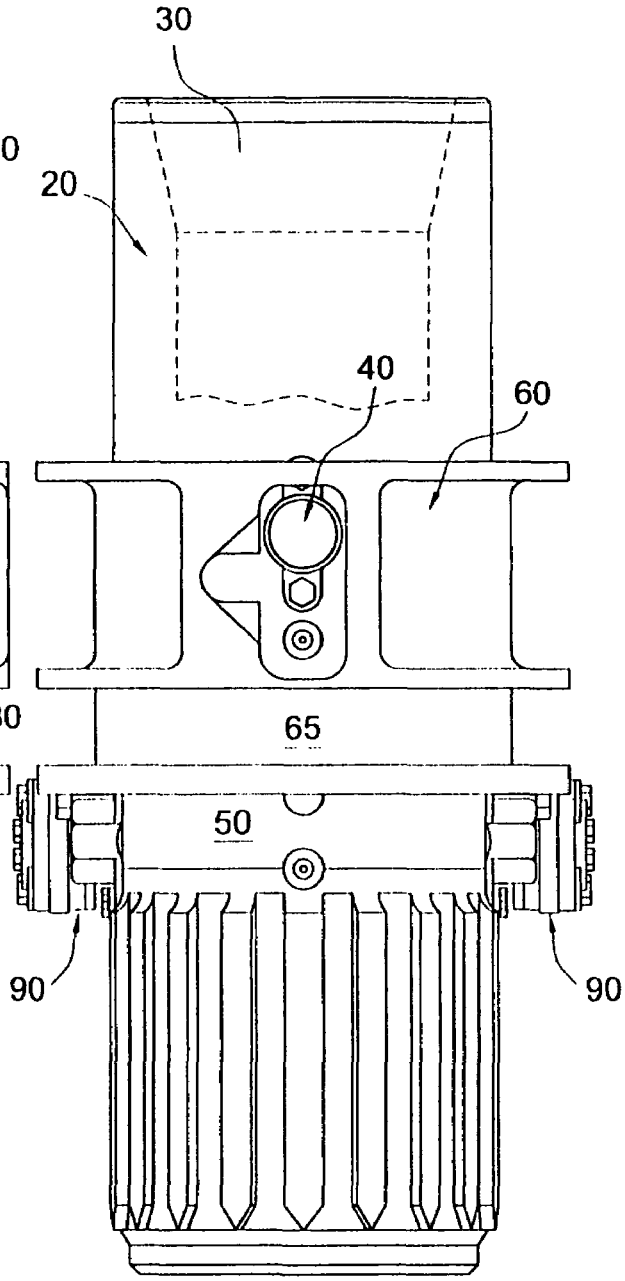
Figure 7A:
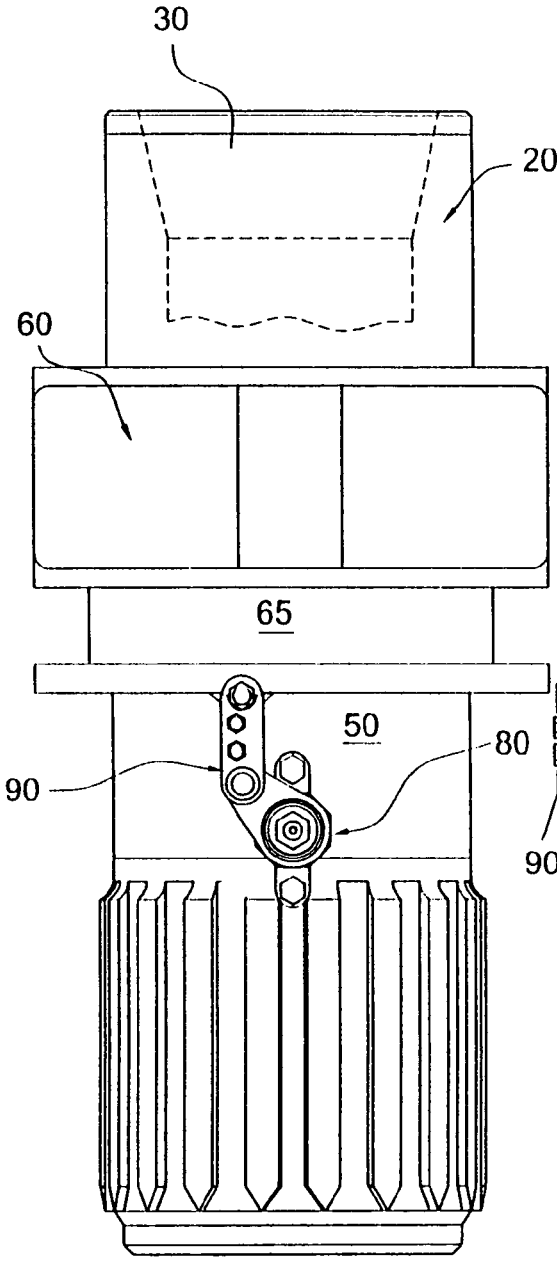
FIGS. 7A and 7B are views of the remotely operable top drive valve of the present invention, with the linkage assembly installed and the actuating sleeve shifted from the position shown in FIGS. 6A and 6B.
Figure 7B:
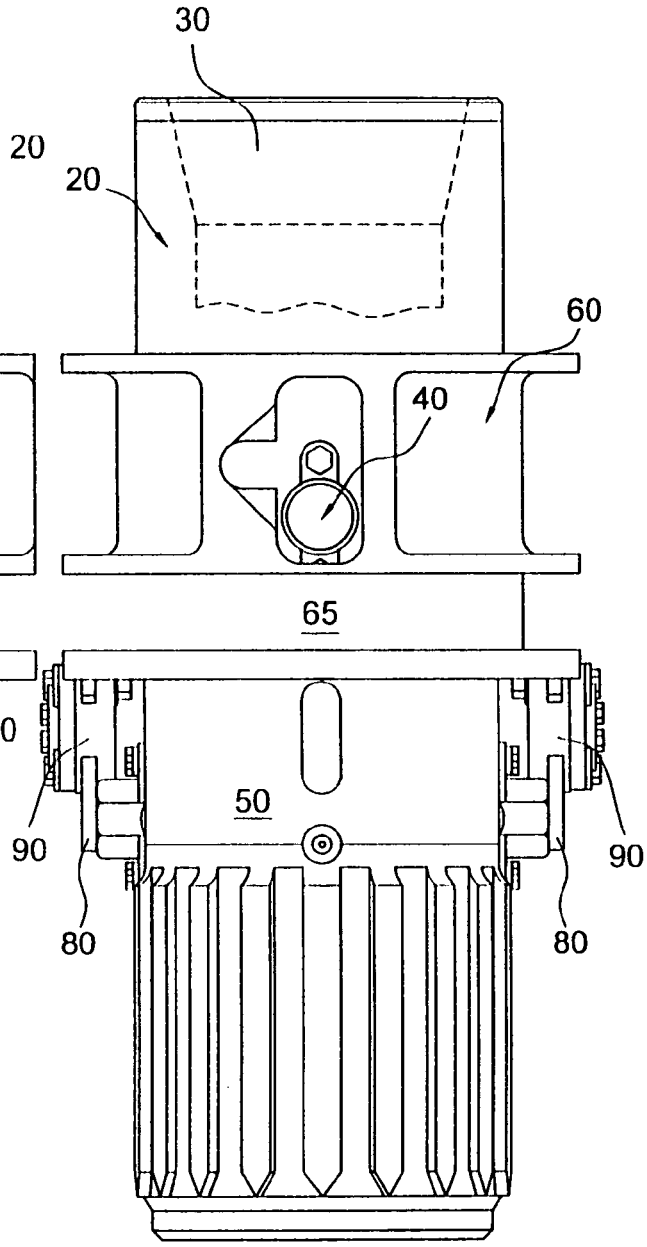
Figure 8:
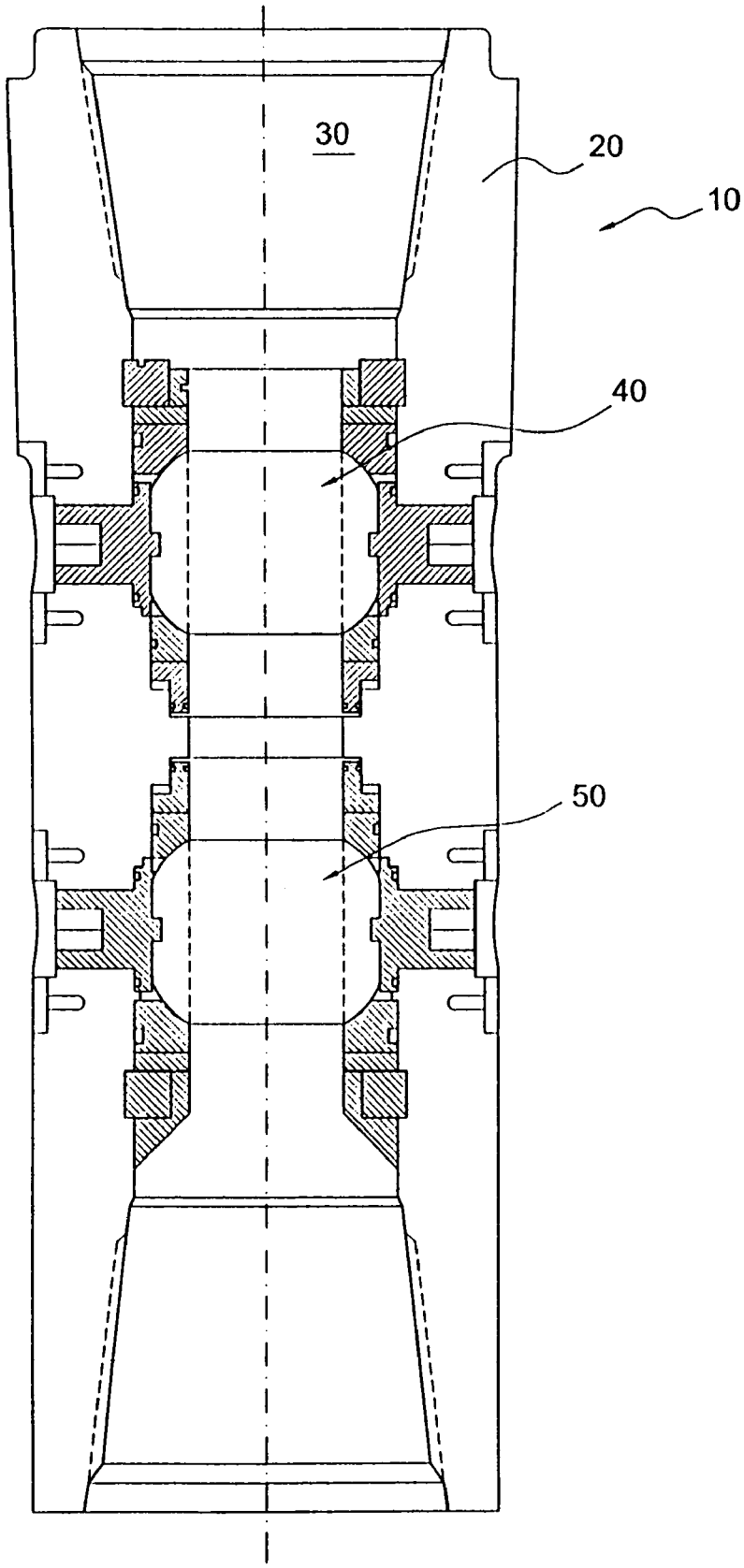
FIG. 8 is a view of another embodiment of the top drive valve of the present invention, wherein the first and second valve elements are aligned (that is, their stems are aligned one with the other, rather than being at right angles to one another as in FIGS. 4A-7B above).

FIGS. 6A, 6B, 7A, and 7B show the present top drive valve assembly with the second valve element 50 in service. When it is desired to operate second valve element 50 (for example, after first valve element 40 has failed a pressure or function test), first valve element 40 is placed in an open position and arm 80 is removed from the valve stem thereof (thereby operationally disengaging first valve element 40 from actuator sleeve 60). Preferably, blinding plates are then installed over the stem ends. With reference to FIGS. 6A and 6B, the apparatus (when the second valve element 50 is in operation) comprises a means for operationally engaging actuator sleeve 60 with second valve element 50, which comprises at least one linkage assembly 90 connecting actuator sleeve 90 with arm 80 of the valve element of second valve element 50, thereby operationally engaging actuator sleeve 60 with second valve element 50. Movement of actuator sleeve 60 longitudinally along main body 20 thereby rotates (via linkage assembly 90) the stem of the lower valve element between open and closed positions, as desired. FIG. 6A shows second valve element 50 in an open position, while FIG. 6B shows actuator sleeve 60 shifted and second valve element 50 in a closed position. While, in the preferred embodiment shown, the apparatus comprises two linkage assemblies 90, one attached to each end of the stem, it is understood that other embodiments of the present invention may comprise only a single linkage assembly attached to one end of the stem. FIGS. 7A and 7B show the top drive valve assembly from two points of view at 90 degrees apart.

In FIGS. 4A-7B, the stems of the two valve elements are aligned 90 degrees apart, as can be seen in the drawings. It is understood that the present invention comprises top drive valve assemblies having multiple valve elements, wherein the valve stems are aligned 90 degrees apart; are aligned with one another as in FIG. 8; or any other rotational position one to the other.

The top drive safety valve can be made of materials well known in the relevant art, preferably metallic materials of suitable types, with some non-metallic parts as appropriate. Dimensions can be altered to suit particular applications.

This disclosure of a novel top drive safety valve assembly comprising multiple valve elements is of one of the presently preferred embodiments of the invention, and is not to be construed as limiting the scope of the invention to the particular disclosure.

While the preceding specification sets forth many specificities, same are offered to describe some of the presently preferred embodiments and not by way of limitation. Various changes could be made from the described embodiments without departing from the spirit of the invention. For example, two or more than two valve elements could be included; the valve elements may be of the ball valve type, "butterfly" valve type, or other sealing valve type; the detailed shape of the actuator sleeve can be varied; different materials can be used; the safety valve can be made in different sizes to suit particular applications, etc.

Therefore, the scope of the invention should be measured not by the given examples, but by the scope of the appended claims and their legal equivalents.

I claim:

1. A remotely operable safety valve assembly for use with top drive drilling systems, comprising:

a) an elongated main body having a longitudinal bore therethrough;

b) a first valve element disposed in said main body;

c) a second valve element disposed in said main body;

d) an actuator sleeve disposed around said main body and longitudinally slidable thereon in response to a remotely operable actuating arm; and e) means for operatively engaging said actuator sleeve with either said first valve element in a first operating mode or alternatively said second valve element in a second operating mode, wherein:

i) in said first operating mode, said means for operatively engaging said actuator sleeve with said first valve element comprises an external arm attached to said first valve element, said arm engaging a profile in a wall of said actuator sleeve; and ii) in said second operating mode, said external arm is removed, and said means for operatively engaging said actuator sleeve with said second valve element comprises an external arm attached to said second valve element and a linkage connecting said actuator sleeve to said external arm.

2. The apparatus of claim 1, wherein said first and second valve elements comprise ball valve elements.

3. A remotely operable safety valve assembly, particularly adapted for use with top drive drilling systems, comprising:

a) an elongated main body having a longitudinal bore therethrough;

b) first and second valve elements disposed in said main body, wherein said first and second valve elements comprises ball valve elements;

c) an actuator sleeve disposed around said main body and longitudinally movable thereon, in response to remotely generated controls; and d) means for selectively and operatively engaging said actuator sleeve with either said first valve element or alternatively said second valve element, wherein said means for selectively and operatively engaging said actuator sleeve with said first valve element comprises an external arm connected to a stem of said first valve element, and wherein said external arm is disposed within a cutout in a wall of said actuator sleeve which is shared so that longitudinal movement of said actuator sleeve moves said external arm and consequently said first valve element between open and closed positions, and wherein said means for selectively and operatively engaging said actuator sleeve with said second valve element comprises an external arm connected to a stem of said second valve element, and wherein said external arm is connected to said actuator sleeve by a linkage assembly so that longitudinal movement of said actuator sleeve moves said second valve element between open and closed positions.

* * * * *